US006419763B1

(12) United States Patent
Konter et al.

(10) Patent No.: US 6,419,763 B1
(45) Date of Patent: Jul. 16, 2002

(54) NICKEL-BASE SUPERALLOY

(75) Inventors: Maxim Konter, Klingnau; John Fernihough, Baden, both of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/572,301

(22) Filed: May 18, 2000

(30) Foreign Application Priority Data

May 20, 1999 (EP) ..... 99 810443

(51) Int. Cl.[7] ..... C22C 19/05
(52) U.S. Cl. ..... 148/404; 148/428; 420/448
(58) Field of Search ..... 148/404, 428; 420/448

(56) References Cited

U.S. PATENT DOCUMENTS

| | | | | | |
|---|---|---|---|---|---|
| 4,140,555 | A | * | 2/1979 | Garcia et al. | 148/32 |
| 4,721,540 | A | * | 1/1988 | Harris et al. | 148/404 |
| 5,069,873 | A | * | 12/1991 | Harris et al. | 420/448 |
| 5,759,301 | A | * | 6/1998 | Konter et al. | 148/404 |

FOREIGN PATENT DOCUMENTS

| | | |
|---|---|---|
| GB | 2 234 521 | 2/1991 |
| WO | 97/48827 | 12/1997 |
| WO | 97/48828 | 12/1997 |

OTHER PUBLICATIONS

Metals Handbook, ed. by Davis et al, 1990, pub. by ASM International, 10$^{th}$ edition, vol. 1:Properties and Selection: Irons, Steels and High–Performance Alloys, pp. 951,982, 989.*

Ross et al., "René N4: A First Generation Single Crystal Turbine Airfoil Alloy with Improved Oxidation Resistance, Low Angle Boundary Strength and Superior Long Time Rupture Strength", *Superalloys 1996*, Sep. 22–26, 1996, pp. 19–25.

Walston et al., "René N6: Third Generation Single Crystal Superalloy", *Superalloys 1996*, Sep. 22–26, 1996, pp. 27–34.

*Metals Handbook*, 10th Edition, vol. 1, Properties and Selection: Irons, Steels, and High–Performance Alloys, "Polycrystalline Cast Superalloys", 1990, pp. 990–994.

*Metals Handbook*, 10th Edition, vol. 1, Properties and Selection: Irons, Steels, and High–Performance Alloys, "Specialty Steels and Heat–Resistant Alloys", 1990, p. 1000.

Quigg, "New Alloy Developments in Single Crystal and DS Alloys", *High Temperature Materials and Processes*, vol. II, No. 1–4, 1993, pp. 248–254.

Harris et al., "Development of Two Rhenium–Containing Superalloys for Single–Crystal Blade and Directionally Solidified Vane Applications in Advanced Turbine Engines", *Journal of Materials Engineering and Performance*, vol. 2(4), Aug. 1993, pp. 481–487.

Caruel et al., "SNECMA Experience with Cost–Effective DS Airfoil Technology Applied Using CM 186 LC® Alloy", *Journal of Engineering for Gas Turbines and Power*, vol. 120, Jan. 1998, pp. 97–104.

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P.

(57) ABSTRACT

A nickel-base superalloy, in particular for the production of single-crystal components or directionally solidified components, comprising (measured in % by weight): 3.0–13.0% Cr, 5.0–15.0% Co, 0–3.0% Mo, 3.5–9.5% W, 3.2–6.0% Al, 0–3.0% Ti, 2.0–10.0% Ta, 0–6.0% Re, 0.002–0.08% C, 0–0.04% B, 0–1.4% Hf, 0–0.005% Zr, 10–60 ppm N, remainder nickel plus impurities. As a result of the addition of nitrogen in defined quantities, TiN is formed during solidification and carbides with a block morphology are formed. It is thus possible to increase the carbon content without deterioration in the low cycle fatigue at high load temperature.

22 Claims, 1 Drawing Sheet

NICKEL-BASE SUPERALLOY

FIELD OF THE INVENTION

The invention relates to the field of materials engineering. It relates to a nickel-base superalloy, in particular for the production of single-crystal components (SX alloy) or components with a directionally solidified microstructure (DS alloy), such as for example blades for gas turbines.

BACKGROUND OF THE INVENTION

Such components made from nickel-base superalloys exhibit very good strength properties at high temperatures. It is thus possible to increase the inlet temperature of gas turbines, so that the efficiency of the gas turbine rises.

However, a perfect, relatively large, directionally solidified single-crystal component made from a nickel-base superalloy is extremely difficult to cast, because most such components exhibit flaws, for example grain boundaries, freckles (i.e. defects caused by a chain of identically oriented grains with a high eutectic content), equiaxial scatter limits, microporosity and the like. These flaws weaken the components at elevated temperatures, so that the desired service life and/or the operating temperature of the turbine are not achieved. However, since a perfectly cast single-crystal component is extremely expensive, the industry tends to permit as many defects as possible without impairing the service life or the operating temperature.

Grain boundaries constitute one of the most common forms of flaws, and are particularly damaging to the high-temperature properties of the single-crystal articles.

Grain boundaries are regions with a high local disorder in the crystal lattice, since in these regions neighboring grains butt against one another, resulting in a certain misorientation between the crystal lattices. The greater the misorientation, the greater the disorder, i.e. the greater the number of dislocations in the grain boundaries which are required for the two grains to fit together. This disorder is directly related to the performance of the material at high temperatures. It weakens the material if the temperature rises beyond the equicohesive temperature (=0.5×melting point in ° K).

This effect is known from GB 2,234,521 A. For example, in a conventional nickel-base single-crystal alloy, at a test temperature of 871° C. the breaking strength falls extremely quickly if the misorientation of the grains is greater than 6°. This was also observed in single-crystal components with a directionally solidified microstructure, so that consequently it has become the accepted view that misorientation of greater than 6° should not be permitted.

It is also known from the abovementioned GB 2,234,521 A that enriching nickel-base superalloys with boron or carbon combined with directional solidification produces microstructures which have an equiaxial or prismatic grain structure. Carbon and boron strength the grain boundaries, since C and B cause the precipitation of carbides and borides at the grain boundaries, compounds which are stable at high temperatures. Moreover, the presence of these elements reduces the diffusion process in and along the grain boundaries, which is a primary cause of the weakness of the grain boundaries. It is therefore possible to increase the misorientation to 12° while nevertheless achieving good materials properties at high temperatures if the carbon content is made higher than in conventional single-crystal alloys (250 to 770 ppm) but lower than in previous DS alloys (700 to 1600 ppm). An upper limit is defined by the growing carbide size, which has an adverse effect on the low cycle fatigue (LcF).

The latest SX alloys have a carbon content of 500 ppm. This level is regarded as optimum in terms of the defect tolerance (tolerance with regard to small-angle grain boundaries) ("Rene N4: A First Generation Single Crystal Turbine Airfoil Alloy", Superalloys, pp. 19–26, and "Rene N6: Third Generation Single Crystal Superalloy", pp. 27–34, The Minerals Metals and Materials Society, 1996).

For all these nickel-base superalloys, it is the case that the carbon content is limited by the size of the carbides which form during the solidification. Large Chinese script like carbides reduce the service life with low cycles to approximately half the service life achieved by the same alloy with small carbides in block form (Metals Handbook, 10th edition, 1990, ASM International, Vol. 1, p. 991).

It is also known that conventionally cast nickel-base superalloys (CC or equiaxial) can be provided with additions of magnesium, calcium, cerium or other rare earths, which influence the carbide morphology. The abovementioned elements have a high reactivity, so that although they are suitable for CC alloys, owing to the short contact times with the shell mold, they are unsuitable for casting of DS and SX alloys, in which the molten alloy is in contact with the shell mold at high temperatures for a long time, since these additions reduce the silicon content in the shell mold and lead to slag formation on the cast surface. Moreover, the quantitative proportions of these additions vary adversely over the height of the casting, smaller quantities being present in that part of the casting which solidified last. This is undesirable, since as a result the carbide morphology varies over the length of the casting.

Furthermore, it is known prior art to keep the nitrogen content of SX and DS nickel-base superalloys to an absolute minimum. Nitrogen is regarded as a harmful impurity which has an adverse effect on the grain region and leads to the formation of nonmetallic inclusions, for example nitrides of titanium or tantalum. Grain defects may form at these inclusions (Metals Handbook, 10th edition, 1990, ASM International, Vol. 1, p. 1000), having an adverse effect on the properties of the alloys.

SUMMARY OF THE INVENTION

The invention aims to avoid all these drawbacks. It is based on the object of providing a nickel-base superalloy (SX or DS alloy) for producing single-crystal components which, compared to the known prior art, is distinguished by a greater tolerance of small-angle grain boundaries while nevertheless exhibiting very good low cycle fatigue at high load temperatures.

Single-crystal components are to be understood as meaning articles made from single crystals and articles with a directionally solidified microstructure.

According to the invention, this is achieved by providing a nickel-base superalloy comprising (measured in % by weight): 3.0–13.0% Cr; 5.0–15.0% Co; 0–3.0% Mo; 3.5–9.5% W; 3.2–6.0% Al; 0–3.0% Ti; 2.0–10.0% Ta; 0–6.0% Re; 0.002–0.08% C; 0–0.04% B; 0–1.4% Hf; 0–0.005% Zr; and 10–60 ppm N; with the remainder of the superalloy including nickel plus impurities. Alternatively, the object of the invention may be achieved by providing a nickel-base superalloy comprising (measured in % by weight): 6.0–6.8% Cr; 8.0–10.0% Co; 0.5–0.7% Mo; 6.2–6.7% W; 5.4–5.8% Al; 0.6–1.2% Ti; 6.3–7.0% Ta; 2.7–3.2% Re; 0.02–0.04% C; 40–100 ppm B; 0.15–0.3% Hf; 15–50 ppm Mg; 0–400 ppm Y; 10–60 ppm N; with the remainder including nickel plus impurities. In a preferred embodiment of the invention, the nickel-base superalloy essentially consists of (measured in % by weight) 3.0–13.0% Cr, 5.0–15.0% Co, 0–3.0% Mo, 3.5–9.5% W, 3.2–6.0% Al, 0–3.0% Ti, 2.0–10.0% Ta, 0–6.0% Re, 0.002–0.08% C, 0–0.04% B, 0–1.4% Hf, 0–0.005% Zr, 10–60 ppm N, remainder nickel plus impurities. In another preferred embodiment, the nickel-base superalloy essentially consists of (measured in % by weight) 6.0–6.8% Cr, 8.0–10.0% Co, 0.5–0.7% Mo, 6.2–6.7% W, 5.4–5.8% Al, 0.6–1.2% Ti, 6.3–7.0% Ta, 2.7–3.2% Re, 0.02–0.04% C, 40–100 ppm B, 0.15–0.3% Hf, 15–50 ppm Mg, 0–400 ppm Y, 10–60 ppm N, remainder nickel plus impurities.

The advantages of the invention are, inter alia, that the carbides have a favorable block morphology due to the controlled addition of small quantities of nitrogen to DS or SX nickel-base superalloys. As a result, it is possible to increase the carbon content compared to the known prior art without this resulting in deterioration in the low cycle fatigue at high temperatures. The higher carbon content has a beneficial effect on the small-angle grain boundaries.

A further advantage is that due to the block morphology of the carbides, the known phenomenon of long script-like carbides, which oxidize very rapidly along their length and therefore increase the level of oxidation of the alloy, is eliminated, these long script-like carbides often being the points at which crack initiation is found. The alloy according to the invention is consequently distinguished by a high resistance to oxidation of the small-angle grain boundaries and by improved longitudinal and transverse mechanical properties.

Finally, another advantage of the invention is that, in contrast to the reactive elements such as Mg, Ce or other rare earths, nitrogen does not react with the shell mold during casting, so that the composition of the alloy remains constant over the entire length of the casting.

It is advantageous if the nickel-base superalloy consists of (in % by weight) 6% Cr, 9% Co, 0.5% Mo, 8% W, 5.7% Al, 0.7% Ti, 3% Ta, 3% Re, 0.07% C, 0.015% B, 1.4% Hf, 0.005% Zr, 10–60 ppm N, remainder nickel plus impurities.

A nickel-base superalloy comprising (measured in % by weight) 3.0–13.0% Cr, 5.0–15.0% Co, 0–3.0% Mo, 3.5–9.5% W, 3.2–6.0% Al, 0–3.0% Ti, 2.0–10.0% Ta, 0–6.0% Re, 0.002–0.08% C, 0–0.04% B, 0–0.05% Hf, 10–60 ppm N, remainder nickel plus impurities is also advantageous. These alloys are nickel-base superalloys which are known per se and the composition of which has been modified by the controlled addition of nitrogen.

It is particularly expedient if the nickel-base superalloys described above have a nitrogen content of 15 to 50 ppm, preferably 20 to 40 ppm. Above 60 ppm N. agglomerates of TiN particles which cause a deterioration in the properties are formed, and consequently this limit should not be exceeded.

The invention also relates to single-crystal components, for example blades of gas turbines, which are produced from the abovementioned alloys according to the invention.

DETAILED DESCRIPTION OF THE PREFERRED EMBODIMENTS

According to the present invention, nickel-base superalloys (SX and DS alloys, i.e. single-crystal alloys and alloys with a directionally solidified microstructure) are provided, in a controlled manner, with small additions of nitrogen.

Hitherto, in alloys of this nature nitrogen was always considered to be an undesirable foreign element, the level of which was to be minimized. Although a relationship between a high carbon content and a high small-angle grain boundary tolerance is known from the prior art, hitherto no work has been undertaken to solve the problem of the carbide size.

A nickel-base superalloy according to the invention, in particular for the production of single-crystal components or directionally solidified components, consists of (measured in % by weight) 3.0–13.0% Cr, 5.0–15.0% Co, 0–3.0% Mo, 3.5–9.5% W, 3.2–6.0% Al, 0–3.0% Ti, 2.0–10.0% Ta, 0–6.0% Re, 0.002–0.08% C, 0–0.04% B, 0–1.4% Hf, 0–0.005% Zr, and 10–60 ppm N, remainder nickel plus impurities. A further nickel-base superalloy according to the invention consists, for example, of (measured in % by weight) 6.0–6.8% Cr, 8.0–10.0% Co, 0.5–0.7% Mo, 6.2–6.7% W, 5.4–5.8% Al, 0.6–1.2% Ti, 6.3–7.0% Ta, 2.7–3.2% Re, 0.02–0.04% C, 40–100 ppm B, 0.15–0.3% Hf, 15–50 ppm Mg, 0–400 ppm Y, 10–60 ppm N, remainder nickel plus impurities. An alloy of this nature, but without the nitrogen content indicated, is known from U.S. Pat. No. 5,759,301.

The invention also relates to a nickel-base superalloy containing (measured in % by weight) 6% Cr, 9% Co, 0.5% Mo, 8% W, 5.7% Al, 0.7% Ti, 3% Ta, 3% Re, 0.07% C, 0.015% B, 1.4% Hf, 0.005% Zr, 10–60 ppm N, remainder Ni plus impurities. An alloy of this nature, but without the nitrogen content indicated, is known under the name CM186 LC.

Finally, a further nickel-base superalloy according to the invention comprises (measured in % by weight) 3.0–13.0% Cr, 5.0–15.0% Co, 0–3.0% Mo, 3.5–9.5% W, 3.2–6.0% Al, 0–3.0% Ti, 2.0–10.0% Ta, 0–6.0% Re, 0.002–0.08% C, 0–0.04% B, 0–0.5% Hf, 10–60 ppm N, remainder nickel plus impurities.

The addition of nitrogen results in precipitation of TiN during solidification. This leads to a change in the morphology of the carbides. The formation of harmful Chinese script-like, elongate carbides is suppressed, whereas small carbides with a block morphology form even if the carbon content is increased within defined limits while the chemical composition otherwise remains the same. C is a grain boundary element which has a positive effect on the small-angle grain boundaries.

Figure 1:
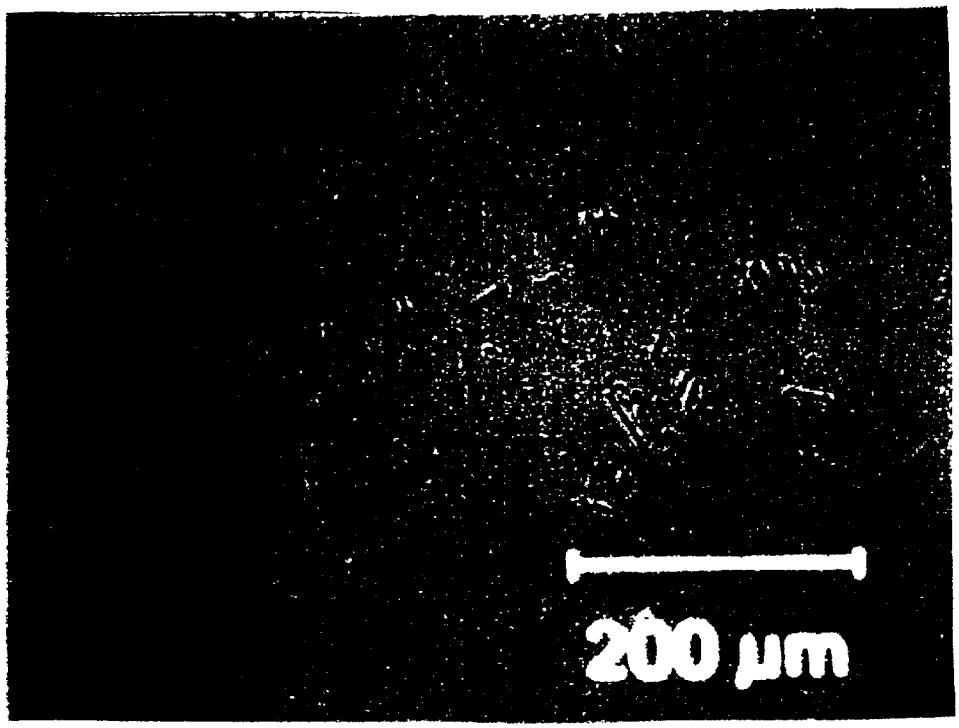
FIG. 1 shows a microsection through a DS alloy containing 5 ppm of nitrogen with a directionally solidified microstructure.
Figure 2:
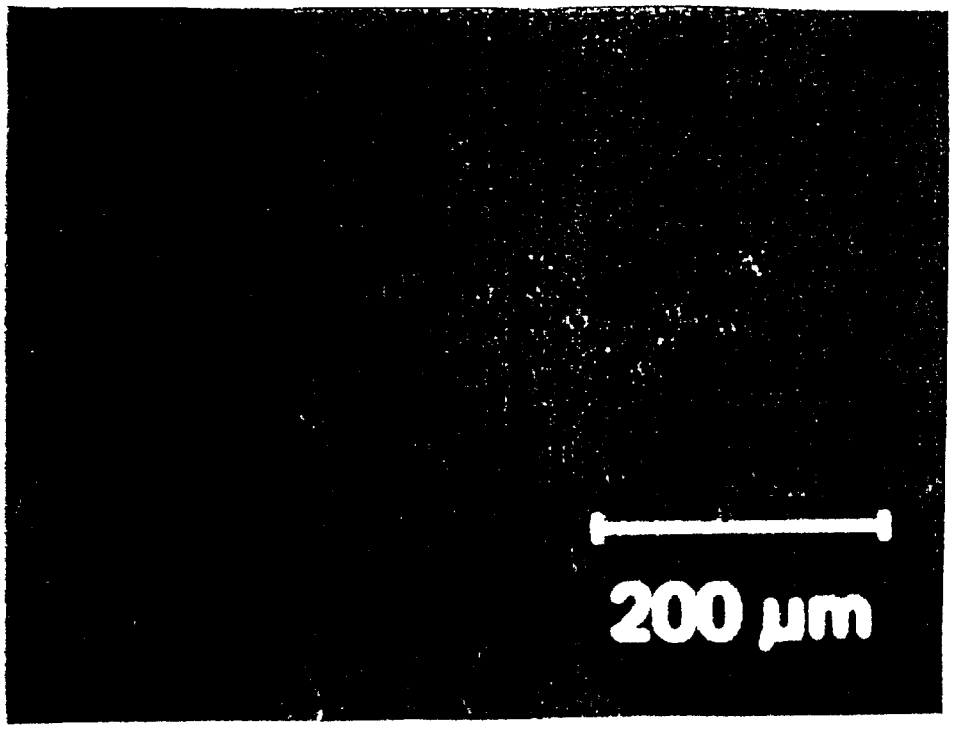
FIG. 2 show a microsection through a DS alloy containing 20 ppm of nitrogen with a directionally solidified microstructure.

This is clearly apparent from an example shown in FIGS. 1 and 2, which show microsections through nickel-base superalloys with a directionally solidified microstructure (DS alloy) for single-crystal components.

The composition of the alloys differs only in terms of the carbon content and the nitrogen content, as can be seen from the following table. The values are given in % by weight or in ppm (*).

| | Cr | Co | W | Al | Ti | Ta | C | $O_2$* | $N_2$* |
|---|---|---|---|---|---|---|---|---|---|
| A1 | 11.95 | 8.95 | 8.95 | 3.60 | 2.00 | 5.65 | 0.076 | 10.0 | 20.0 |
| CA2 | 11.89 | 8.96 | 8.95 | 3.75 | 2.01 | 5.81 | 0.064 | 10.0 | 5.0 |

As can be seen clearly from FIGS. 1 and 2, during the directional solidification small carbides with a block morphology form in the first alloy Al (with a higher nitrogen content), despite the fact that this alloy has a higher carbon content than the second alloy CA2, while in the second alloy (comparison alloy CA2), large carbides with a script-like morphology are formed during the directional solidification.

The alloys according to the invention are distinguished by a high resistance to oxidation of the small-angle grain boundaries and by improved longitudinal and transverse mechanical properties. The susceptibility to crack initiation is reduced and the alloys are distinguished by a very good fatigue behavior at high temperatures. Since the nitrogen does not react with the shell mold during the casting and solidification, which lasts for a relatively long time in the case of DS alloys, the chemical composition along the casting, and therefore also the properties, are constant, which is advantageous.

The nitrogen content in the SX and DS alloys according to the invention is advantageously 15 to 50 ppm or 20 to 40 ppm. A maximum of 60 ppm N should not be exceeded, since above this level TiN agglomerates form, and consequently the TiN is no longer finally distributed and, consequently, the morphology of the carbides which form once again disadvantageously changes to larger Chinese script-like carbides.

The addition of nitrogen may also be effected according to the following formulae, either on their own or in combination, the final addition of nitrogen being the sum of the results of the combination:

N (in ppm)=(0.01–0.02) C (in ppm)

N (in ppm)=(1.0–5.0) % by weight Cr

N (in ppm)=(1.0–4.0) % by weight C+3% by weight Ti+0.7% by weight Ta+0.11 (% by weight W+% by weight Re)+0.6% by weight Co−0.682% by weight Al.

The nitrogen may be added to the alloy in a wide variety of forms, for example in solid form as TiN, ZrN, TaN, CrN, BN or other solid nitrides, but also as liquid nitrides. The alloy according to the invention may also be produced using nitrogen-enriched material, e.g. Cr, Ti. Furthermore, production in a nitrogen atmosphere or a nitrogen-containing atmosphere or the injection of this gas into the alloy or blowing this gas over the alloy are also conceivable, as is casting of the molten alloy in a nitrogen atmosphere or a nitrogen-containing atmosphere.

The alloy according to the invention is used in particular for the production of single-crystal components (single crystals or directionally solidified microstructures), for example turbine blades of gas turbines. Naturally, the invention is not limited to the exemplary embodiments indicated. Large components made from the alloy according to the invention may also be incorporated in other machines in which a stable structure and very good mechanical properties are required at high temperatures.

What is claimed is:

1. A nickel-base superalloy, comprising (measured in % by weight):

3.0–13.0% Cr;
5.0–15.0% Co;
0–3.0% Mo;
3.5–9.5% W;
3.2–6.0% Al;
0–3.0%-Ti;
2.0–10.0% Ta;
0–6.0% Re;
0.002–0.08% C;
0–0.04% B;
0–1.4% Hf;
0–0.005% Zr;
20–60 ppm N;
and a remainder including nickel plus impurities.

2. The nickel-base superalloy as claimed in claim 1, comprising (measured in % by weight):

6% Cr;
9% Co;
0.5% Mo;
8% W;
5.7% Al;
0.7% Ti;
3% Ta;
3% Re;
0.07% C;
0.015% B;
1.4% Hf;
0.005% Zr;
20–60 ppm N;
and a remainder including nickel plus impurities.

3. A directionally solidified component comprising the nickel-base superalloy of claim 2.

4. The nickel-base superalloy as claimed in claim 1, comprising (measured in % by weight):

3.0–13.0% Cr;
5.0–15.0% Co;
0–3.0% Mo;
3.5–9.5% W;
3.2–6.0% Al;
0–3.0% Ti;
2.0–10.0% Ta;
0–6.0% Re;
0.002–0.08% C;
0–0.04% B;
0–0.5%-Hf;
20–60 ppm N;
and a remainder including nickel plus impurities.

5. A directionally solidified component comprising the nickel-base superalloy of claim 4.

6. The nickel-base superalloy as claimed in claim 1, which has a nitrogen content of 20–50 ppm.

7. The nickel-base superalloy as claimed in claim 1, which has a nitrogen content of 20–40 ppm.

8. The nickel-base superalloy as claimed in claim 1, wherein N (in ppm)=(0.01–0.2) ppm C.

9. The nickel-base superalloy as claimed in claim 1, wherein N (in ppm)=(1.0–5.0) % by weight Cr.

10. The nickel-base superalloy as claimed in claim 1, wherein N (in ppm)=(1.0–4.0) % by weight C+3% by weight Ti+0.7% by weight Ta+0.11 (% by weight W+% by weight Re)+0.6 by weight Co−0.682% by weight Al.

11. A directionally solidified component comprising the nickel-base superalloy of claim 1.

12. A nickel-base superalloy, comprising (measured in % by weight):

6.0–6.8% Cr;
8.0–10.0% Co;
0.5–0.7% Mo;
6.2–6.7% W;

5.4–5.8% Al;
0.6–1.2% Ti;
6.3–7.0% Ta;
2.7–3.2% Re;
0.02–0.04% C;
40–100 ppm B;
0.15–0.3% Hf;
15–50 ppm Mg;
0–400 ppm Y;
20–60 ppm N;
and a remainder including nickel plus impurities.

13. A directionally solidified component comprising the nickel-base superalloy of claim 12.

14. A nickel-base superalloy single-crystal component, consisting of (measured in % by weight):
6% Cr;
9% Co;
0.5% Mo;
8% W;
5.7% Al;
0.7% Ti;
3% Ta;
3% Re;
0.07% C;
0.015% B;
1.4% Hf;
0.005% Zr;
20–60 ppm N;
and a remainder including nickel plus impurities.

15. A nickel-base superalloy single-crystal component, consisting of (measured in % by weight):
3.0–13.0% Cr;
5.0–15.0% Co;
0–0.3% Mo;
3.5–9.5% W;
3.2–6.0% Al;
0–3.0% Ti;
2.0–10.0% Ta;
0–6.0% Re;
0.002–0.08% C;
0–0.04% B;
0–0.5% Hf;
20–60 ppm N;
and a remainder including nickel plus impurities.

16. A nickel-base superalloy single-crystal component, consisting of (measured in % by weight):
6.0–6.8% Cr;
8.0–10.0% Co;
0.5–0.7% Mo;
6.2–6.7% W;
5.4–8% Al;
0.6–1.2% Ti;
6.3–7.0% Ta;
2.7–3.2% Re;
0.02–0.04% C;
40–100 ppm B;
0.15–0.3% Hf;
15–50 ppm Mg;
0–400 ppm Y;
20–60 ppm N;
and a remainder including nickel plus impurities.

17. A nickel-base superalloy single-crystal component, consisting of (measured in % by weight):
3.0–13.0% Cr;
5.0–15.0% Co;
0–3.0% Mo;
3.5–9.5% W;
3.2–6.0% Al;
0–3.0% Ti;
2.0–10.0% Ta;
0–6.0% Re;
0.002–0.08% C;
0–0.04% B;
0–1.4% Hf;
0–0.005% Zr;
20–60 ppm N;
and a remainder including nickel plus impurities.

18. The nickel-base superalloy single-crystal component as claimed in claim 10, which has a nitrogen content of 20 to 50 ppm.

19. The nickel-base superalloy single-crystal component as claimed in claim 17, wherein N (in ppm)=(0.01–0.2) ppm C or N (in ppm)=(1.0–5.0) % by weight Cr or N (in ppm)=(1.0–4.0) % by weight C+3% by weight Ti+0.7% by weight Ta+0.11 (% by weight W+% by weight Re)+0.6% by weight Co−0.682% by weight Al.

20. The nickel-base superalloy single-crystal component as claimed in one of claim 19, wherein the single-crystal component is a blade of a gas turbine.

21. The nickel-base superalloy single-crystal component as claimed in claim 17, which has a nitrogen content of 20 to 40 ppm.

22. A nickel-base superalloy single-crystal component, consisting of (measured in % by weight):
3.0–13.0% Cr;
5.0–15.0% Co;
0–3.0% Mo;
3.5–9.5% W;
3.2–6.0% Al;
0–3.0% Ti;
2.0–10.0% Ta;
0–6.0% Re;
0.002–0.08% C;
0–0.04% B;
0–1.4% Hf;
0–0.005% Zr;
an amount of N effective to suppress formation of large carbides having a script-like morphology;
and a remainder including nickel plus impurities.

* * * * *